US008571453B2

(12) United States Patent
Enomoto et al.

(10) Patent No.: US 8,571,453 B2
(45) Date of Patent: Oct. 29, 2013

(54) IMAGE FORMING APPARATUS AND CHARGE ELIMINATING DEVICE

(75) Inventors: Yoshihiro Enomoto, Kanagawa (JP); Yoshihisa Nakao, Kanagawa (JP); Kiyotoshi Kaneyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 273 days.

(21) Appl. No.: 13/096,596

(22) Filed: Apr. 28, 2011

(65) Prior Publication Data

US 2012/0114399 A1 May 10, 2012

(30) Foreign Application Priority Data

Nov. 9, 2010 (JP) ..... 2010-250995

(51) Int. Cl.
*G03G 15/00* (2006.01)
*G03G 21/00* (2006.01)

(52) U.S. Cl.
USPC ..... 399/315; 399/316; 399/397; 399/400

(58) Field of Classification Search
USPC ..... 399/315, 316, 397, 398, 400
See application file for complete search history.

(56) References Cited

U.S. PATENT DOCUMENTS 4,055,380 A * 10/1977 Borostyan ..... 399/316
5,130,752 A * 7/1992 Morishita et al. ..... 399/315
5,225,879 A * 7/1993 Hayashida ..... 399/315
5,339,144 A * 8/1994 Nakai et al. ..... 399/315
5,453,823 A * 9/1995 Hashizume et al. ..... 399/316
5,655,190 A * 8/1997 Fuchiwaki
6,169,875 B1 * 1/2001 Tidrick ..... 399/400
7,515,868 B2 * 4/2009 Miller et al. ..... 399/398
2006/0198668 A1 * 9/2006 Tsujita ..... 399/315

FOREIGN PATENT DOCUMENTS

JP 57062066 A * 4/1982
JP 63286861 A * 11/1988
JP 2008-76680 A 4/2008

* cited by examiner

*Primary Examiner* — Susan Lee
(74) *Attorney, Agent, or Firm* — Sughrue Mion, PLLC

(57) ABSTRACT

An image forming apparatus includes a toner image forming unit that forms a toner image, a transfer unit that transfers the toner image onto a recording material, a fixing unit that fixes the toner image to the recording material, a transport unit that includes a rotary member that transports the recording material from the transfer unit to the fixing unit and a recording material guiding portion that has first protruding portions extending along a recording material transport direction, and a charge eliminating unit that is disposed between the transfer unit and transport unit and eliminates charge on the recording material. The charge eliminating unit includes a first charge eliminating portion having pointed projections, and a second charge eliminating portion that is disposed on a downstream side of the first charge eliminating portion in the recording material transport direction and is disposed to be out of contact with the recording material.

17 Claims, 5 Drawing Sheets

IMAGE FORMING APPARATUS AND CHARGE ELIMINATING DEVICE

CROSS-REFERENCE TO RELATED APPLICATIONS

This application is based on and claims priority under 35 USC 119 from Japanese Patent Application No. 2010-250995 filed Nov. 9, 2010.

BACKGROUND (i) Technical Field

The present invention relates to an image forming apparatus and a charge eliminating device.

(ii) Related Art

In image forming apparatuses using an electrophotographic system, such as copying machines and printers, a drum-shaped photoconductor is evenly charged and is exposed to light that is controlled on the basis of image information, thereby forming an electrostatic latent image on the photoconductor. The electrostatic latent image is then transformed into a visible image (toner image) using toner, the toner image is transferred onto a recording material, and the transferred image is fixed by a fixing device to form an image.

SUMMARY

According to an aspect of the invention, there is provided an image forming apparatus including: a toner image forming unit that forms a toner image; a transfer unit that transfers the toner image formed by the toner image forming unit onto a recording material; a fixing unit that fixes the toner image transferred by the transfer unit to the recording material; a transport unit that includes a rotary member that transports the recording material from the transfer unit to the fixing unit and a recording material guiding portion that has first protruding portions extending along a recording material transport direction; and a charge eliminating unit that is disposed between the transfer unit and the transport unit and eliminates charge on the recording material. The charge eliminating unit includes a first charge eliminating portion that has pointed projections, and a second charge eliminating portion that is disposed on a downstream side of the first charge eliminating portion in the recording material transport direction and is disposed so as to be out of contact with the recording material.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment of the present invention will be described in detail with reference to the attached drawings.

Description of Entire Image Forming Apparatus

Figure 1:
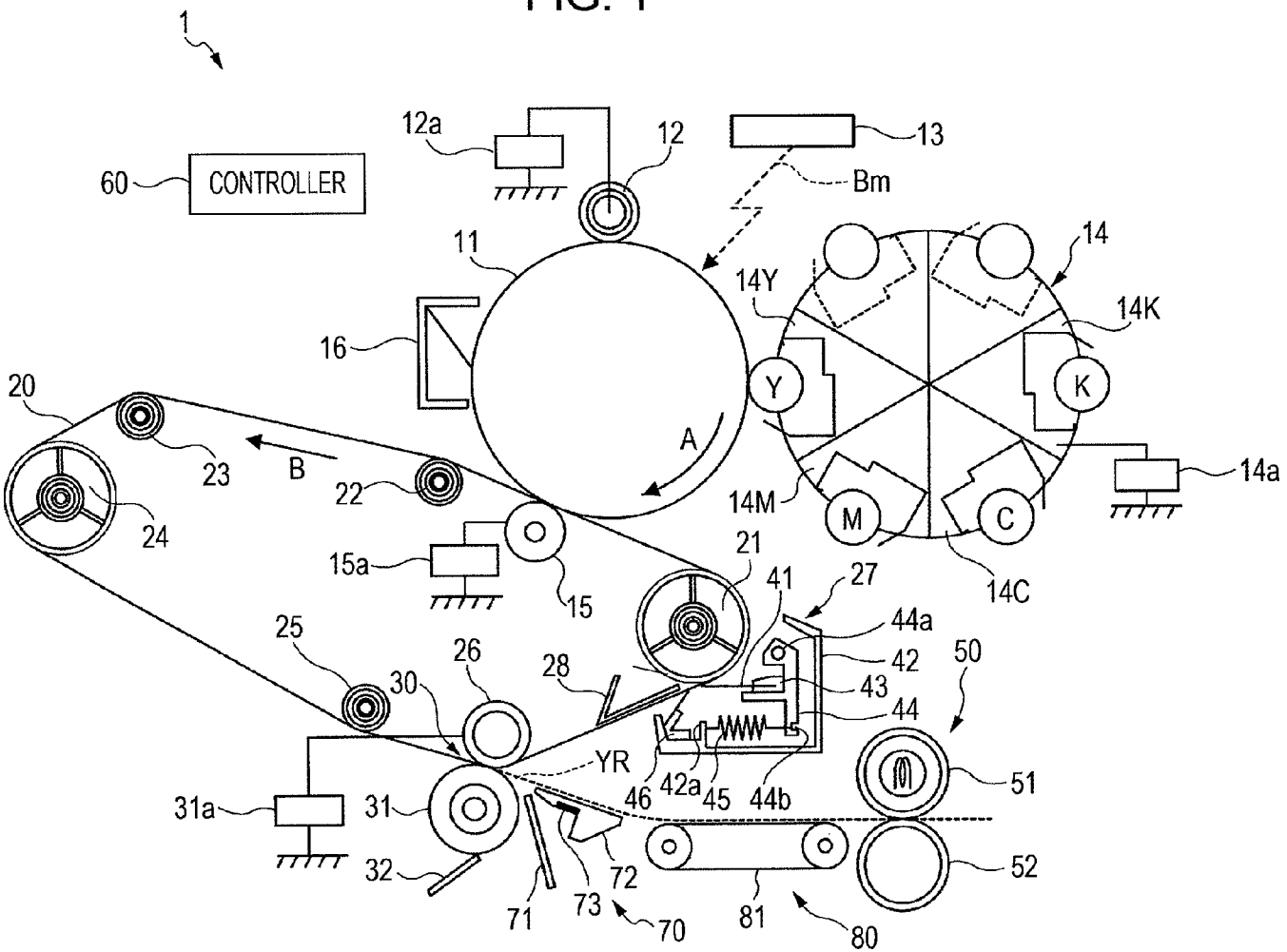
FIG. 1 illustrates a schematic configuration of an image forming apparatus according to an exemplary embodiment of the invention.

FIG. 1 illustrates a schematic configuration of an image forming apparatus 1 according to the exemplary embodiment.

The image forming apparatus 1 includes a photoconductor drum 11, an intermediate transfer belt 20, a second transfer unit 30, a fixing unit 50, a controller 60, a charge eliminating unit 70, and a transport unit 80. The photoconductor drum 11 serves as an image carrier that is disposed so as to be rotatable in the direction indicated by an arrow A. The intermediate transfer belt 20 serves as a transfer material that is disposed so as to be rotatable in the direction indicated by an arrow B and onto which toner images of individual color components formed on the photoconductor drum 11 are sequentially transferred (first transfer) to be held thereon. The second transfer unit 30 transfers (second transfer) the superposed toner image on the intermediate transfer belt 20 onto paper P, which is a recording material. The fixing unit 50 serves as an example of a fixing unit (fixing device) that fixes the second transferred toner image onto the paper P. The controller 60 controls the individual mechanism units of the image forming apparatus 1. The charge eliminating unit 70 serves as an example of a charge eliminating device that eliminates charge from the paper P that is charged by the second transfer unit 30. The transport unit 80 transports the paper P from the second transfer unit 30 to the fixing unit 50.

Electrophotographic devices are sequentially arranged around the photoconductor drum 11, for example, a charging roller 12, a laser exposure device 13, a rotary developing device 14, a first transfer roller 15, and a cleaning blade 16. The charging roller 12 serves as a contact charging member that charges the photoconductor drum 11. The laser exposure device 13 serves as a toner image forming unit that forms an electrostatic latent image on the photoconductor drum 11 (an exposure beam is denoted by reference symbol Bm in FIG. 1). The rotary developing device 14 includes developing units 14Y, 14M, 14C, and 14K that are rotatably mounted in the rotary developing device 14, that contain color toners of yellow (Y), magenta (M), cyan (C), and black (B), respectively, and that develop an electrostatic latent image on the photoconductor drum 11 to form a visible image using the toners. The first transfer roller 15 serves as a transfer unit that transfers toner images of the respective color components formed on the photoconductor drum 11 onto the intermediate transfer belt 20. The cleaning blade 16 collects toner that is charged in a polarity opposite to a usual polarity in the residual toner remaining on the photoconductor drum 11.

Here, the charging roller 12 is made by forming an epichlorohydrin rubber layer on the surface of a metallic shaft and coating the surface of the epichlorohydrin rubber layer with a polyamide layer of about 3 μm containing conductive powder of tin oxide. In the exemplary embodiment, the charging roller 12 may be a scorotron-type charging device.

The photoconductor drum 11 is made by forming an organic photosensitive layer on the surface of a metallic thin cylindrical drum. The organic photosensitive layer is made of a negatively-charged material. Development by the developing units 14Y, 14M, 14C, and 14K is performed using a reversal development scheme. Thus, the toners used in the respective developing units 14Y, 14M, 14C, and 14K are of a negatively-charged type. A charging bias source 12*a* for applying a predetermined charging bias is connected to the charging roller 12, a development bias source 14*a* for applying a predetermined development bias to the individual developing units 14Y, 14M, 14C, and 14*k* is connected to the rotary developing device 14, and a first transfer bias source 15*a* for applying a predetermined first transfer bias is connected to the first transfer roller 15. Also, a developing-device drive motor (not illustrated) for causing a predetermined developing unit to face the photoconductor drum 11 by rotation is attached to the rotary developing device 14. The photoconductor drum 11 is grounded. In the image forming apparatus 1 according to the exemplary embodiment, the photoconductor drum 11, the charging roller 12, the laser exposure device 13, and the rotary developing device 14 may be regarded as a toner image forming unit that forms a toner image.

The intermediate transfer belt 20 extends around plural (six in the exemplary embodiment) rollers 21 to 26. Among them, the roller 21 is a drive roller for the intermediate transfer belt 20, the roller 22 is a metallic idle roller used for positioning the intermediate transfer belt 20 and forming a flat first transfer surface, the roller 23 is a tension roller used for keeping the tension of the intermediate transfer belt 20 constant, the rollers 24 and 25 are driven rollers, and the roller 26 is a backup roller for second transfer (described below). The intermediate transfer belt 20 is made of resin, such as polyimide, polycarbonate, polyester, polypropylene, polyethylene terephthalate, acrylic, or vinyl chloride, various types of rubber, or the like, containing an appropriate amount of carbon black serving as a conductive agent. The surface resistivity of the intermediate transfer belt 20 is 10.8±0.6 log Ω/square, the volume resistivity thereof is 10±2 log Ω·cm, and the thickness thereof is 90±15 μl.

The second transfer unit 30 includes a second transfer roller 31 that is disposed on the side of the toner image holding surface of the intermediate transfer belt 20, the roller 26, and a cleaning blade 32 that removes the residual toner on the second transfer roller 31. The roller 26 is formed of a tube that is made of a blended rubber containing epichlorohydrin rubber and nitride butadiene rubber (NBR). The inner portion of the roller 26 is made of ethylene propylene, diene monomer (EPDM) rubber. The surface resistivity of the roller 26 is 6.7±0.15 log Ω/square, and the harness thereof is 70° (Asker C), for example. A second transfer bias source 31*a* for applying a predetermined second transfer bias is connected to a shaft portion of the roller 26, whereas the second transfer roller 31 is grounded.

On the downstream side of the second transfer unit 30, there is provided a belt cleaner 27 for removing the residual toner that adheres onto the intermediate transfer belt 20 after second transfer. At the position facing the belt cleaner 27 with the intermediate transfer belt 20 therebetween, a sheet metal member 28 is disposed along the inner surface of the intermediate transfer belt 20. The belt cleaner 27 includes a cleaning blade 41 made of urethane and a cleaner housing 42 that houses the cleaning blade 41. One end of the cleaning blade 41 is inserted into a block 43 so as to be fixed, and the block 43 is attached to a holder 44 that swings around a shaft 44*a*. Furthermore, a spring 45 that urges the cleaning blade 41 toward the intermediate transfer belt 20 is disposed between a recessed portion 44*b* on the lower end side of the holder 44 and a protruded portion 42*a* on the bottom of the cleaner housing 42. A film seal 46 for suppressing scattering of removed foreign matter to the outside is disposed on the upstream side of the cleaning blade 41 in the movement direction of the intermediate transfer belt 20.

A cam (not illustrated) connected to a cleaner drive motor (not illustrated) allows the holder 44 to be urged or released in the direction opposite to the urging direction of the spring 45. Accordingly, the cleaning blade 41 may be brought into/out of contact with the intermediate transfer belt 20. In the exemplary embodiment, in the case of forming a multi-color image, the second transfer roller 31 and the belt cleaner 27 are out of contact with the intermediate transfer belt 20 until a toner image of plural colors except the last color has passed by the second transfer roller 31 and the belt cleaner 27.

In the image forming apparatus 1 according to the exemplary embodiment, the intermediate transfer belt 20, the first transfer roller 15, and the second transfer roller 31 constitute a transfer unit that transfers a toner image onto paper.

The fixing unit 50 includes a heating roller 51 having a heat source, such as a halogen lamp, and a pressure roller 52 that is pressed into contact with the heating roller 51. The fixing unit 50 performs fixing by causing paper with a toner image thereon to pass through a fixing nip area that is formed between the heating roller 51 and the pressure roller 52.

Description of Transport Unit

Figure 2:
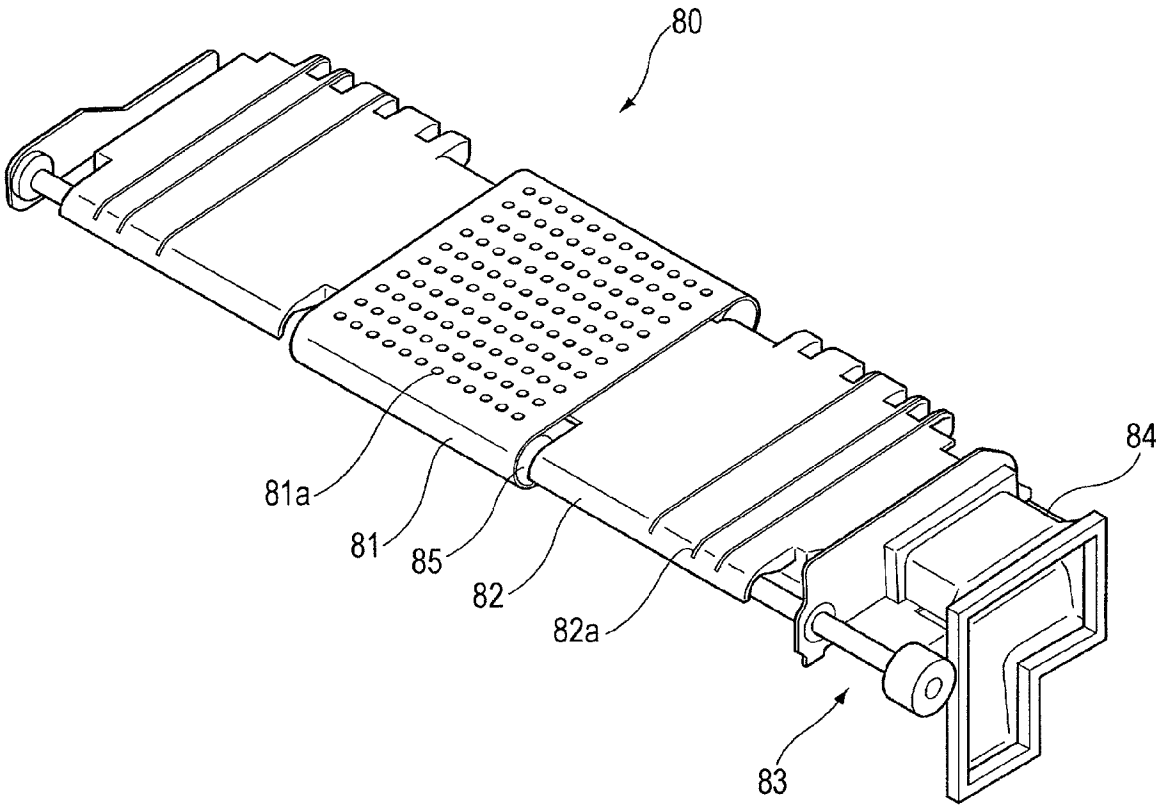
FIG. 2 is a diagram describing a transport unit according to the exemplary embodiment.

FIG. 2 is a diagram describing the transport unit 80 according to the exemplary embodiment.

As illustrated in FIG. 2, the transport unit 80 includes a rotary belt 81 and a paper guiding portion 82. The rotary belt 81 serves as an example of a rotary member that transports paper P from the second transfer unit 30 to the fixing unit 50. The paper guiding portion 82 serves as an example of a recording material guiding portion that guides the paper P toward the outer side in the rotation axis direction of the rotary belt 81. Also, the transport unit 80 includes a drive portion 83 and a duct 84. The drive portion 83 rotates the rotary belt 81. The duct 84 is connected to a fan (not illustrated) and causes an air flow to pass therethrough. The air flow generates a negative pressure that causes the paper P to be sucked onto the rotary belt 81.

The rotary belt 81 is formed of an elastic material, such as rubber. The rotary belt 81 is kept in a tensioned state by a pair of rotary rollers 85, and rotates in accordance with the rotation of the rotary rollers 85. The drive portion 83 is connected to the rotary rollers 85. Thus, when a drive force is generated by the drive portion 83, the rotary belt 81 is rotated by the rotary rollers 85. The rotation of the rotary belt 81 enables the paper P to be transported from the second transfer unit 30 to the fixing unit 50.

The rotary belt 81 is provided with plural hole portions 81*a* that are regularly arranged. The above-described duct 84 is connected to the hole portions 81*a*. When the fan (not illustrated) is rotated, air is sucked from the hole portions 81*a* via the duct 84. Thus, when the paper P is transported onto the rotary belt 81, a negative pressure is generated between the paper P and the rotary belt 81, so that the paper P is transported while being sucked onto the rotary belt 81.

The paper guiding portion 82 has ribs 82*a*, serving as an example of protruding portions that are formed along the transport direction of the paper P. The paper P is transported while being in contact with the ribs 82*a*. Accordingly, the paper P may be transported with a reduced frictional force. The ribs 82*a* may be formed by molding resin or the like on the paper guiding portion 82.

The ribs 82*a* formed on the paper guiding portion 82 may cause disturbance of a transferred toner image. That is, transfer of a toner image onto the paper P by the second transfer unit 30 is performed by applying an electric filed by applying a voltage to the second transfer roller 31, as described above. Thus, if a predetermined amount or more of static electricity generated on the paper P at the time remains until the paper P reaches the transport unit 80, the paper P is easily attracted to the ribs 82*a* due to the static electricity. If the paper P is attracted to the ribs 82*a* due to the static electricity, the friction that occurs between the paper P and the ribs 82*a* causes electric discharge. The electric discharge causes a phenomenon in which the toner on the paper P is scattered along the ribs 82*a*. As a result, disturbance occurs in a toner image, thereby causing disturbance of an image to be formed. The disturbance of the image occurs at portions where the paper P contacts the ribs 82*a* and appears as a streaky pattern that extends in the transport direction of the paper P (sub-scanning direction).

In order to suppress such a phenomenon, the charge eliminating unit 70 that is disposed between the second transfer unit 30 and the transport unit 80 and eliminates charge on the paper P has the following configuration in the exemplary embodiment.

Description of Charge Eliminating Unit

Figure 3:
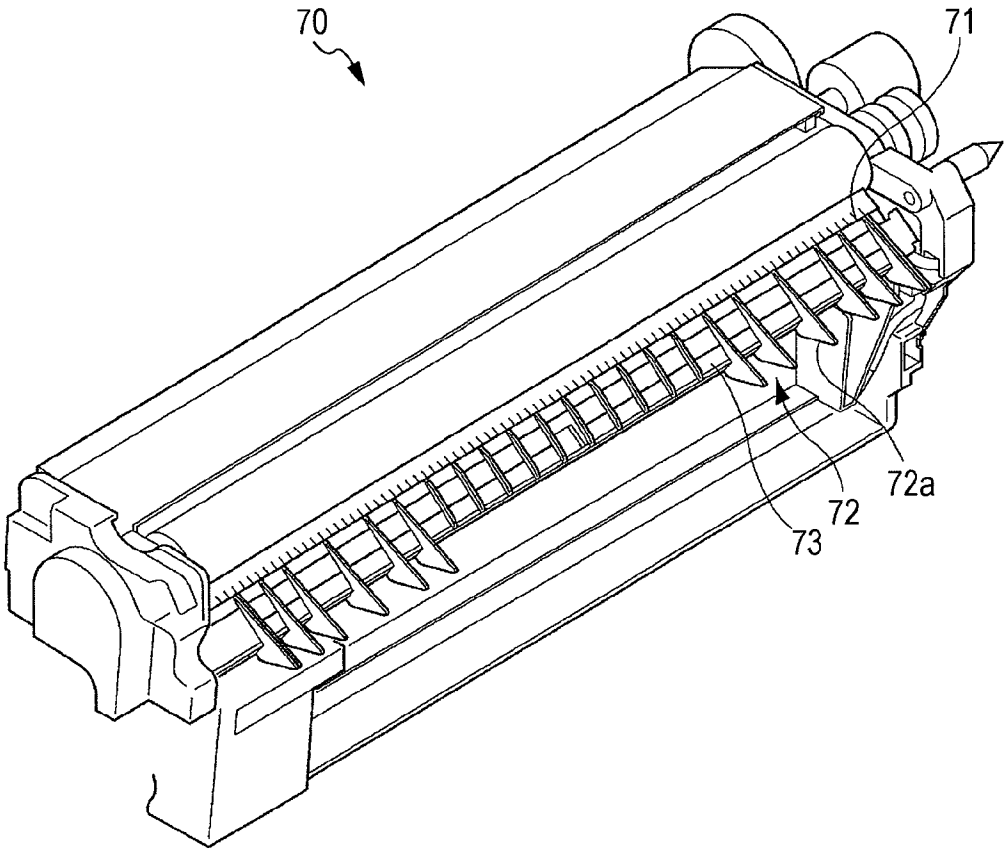
FIG. 3 is a diagram describing a charge eliminating unit according to the exemplary embodiment.

FIG. 3 is a diagram describing the charge eliminating unit 70 according to the exemplary embodiment.

As illustrated in FIG. 3, the charge eliminating unit 70 includes a first charge eliminating portion 71, a transport guiding portion 72 that guides the paper P toward the transport unit 80, and a second charge eliminating portion 73 disposed on the downstream side of the first charge eliminating portion 71 in the paper transport direction. That is, the charge eliminating unit 70 includes two charge eliminating portions that are disposed with a predetermined distance therebetween.

Figure 4A:
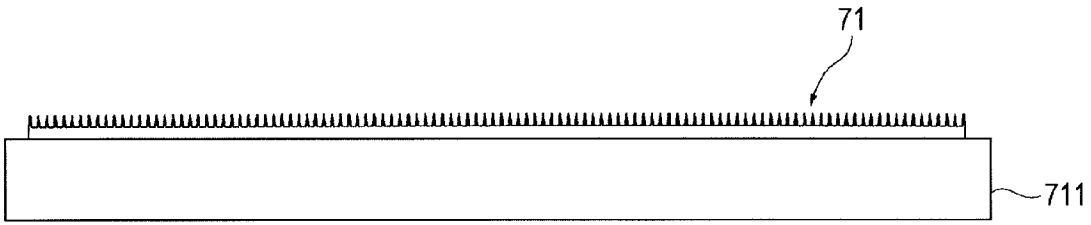
FIGS. 4A and 4B are diagrams describing the details of a first charge eliminating portion.
Figure 4B:
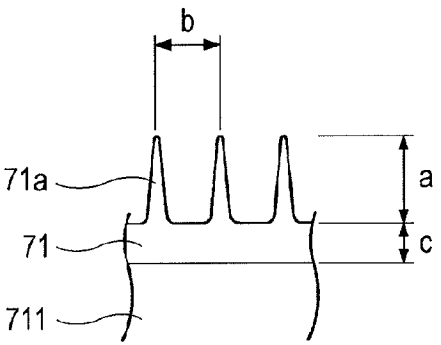

FIGS. 4A and 4B are diagrams describing the first charge eliminating portion 71 more specifically.

The first charge eliminating portion 71 is an electrode made of a metal plate or the like, and the thickness thereof in the paper transport direction is 0.5 mm, for example. The first charge eliminating portion 71 is disposed such that the longer-length direction thereof is substantially parallel to the main scanning direction. As illustrated in FIG. 4A, the first charge eliminating potion 71 is fixed in place by an attachment portion 711. The attachment portion 711 is made of resin or the like, and the first charge eliminating portion 71 is embedded in the attachment portion 711 so as to be fixed in place. Also, the first charge eliminating portion 71 has pointed projections 71*a*. In the exemplary embodiment, each pointed projection 71*a* has a height (a) of 2 mm and a pitch (b) of 3 mm, as illustrated in FIG. 4B. The end portion of the pointed projection 71*a* is oriented in the transport direction of the paper P. When the paper P is transported, the distance between the paper P and the pointed projection 71*a* is 0.5 mm, for example.

The transport guiding portion 72 is a molded product of resin or the like, and has ribs 72*a* that are formed along the transport direction of the paper P. When the paper P is transported from the second transfer unit 30, the paper P is brought into contact with the ribs 72*a* of the transport guiding portion 72 and is guided toward the transport unit 80.

The second charge eliminating portion 73 is a sheet-like member and is disposed such that the longer-length direction thereof is substantially parallel to the main scanning direction. As illustrated in FIGS. 2 and 3, the second charge eliminating portion 73 is disposed at the lower side of the ribs 72*a* of the transport guiding portion 72. That is, the second charge eliminating portion 73 is disposed so as to face the transport path of the paper P, with the ribs 72*a* of the transport guiding portion 72 therebetween. In the exemplary embodiment, the second charge eliminating portion 73 is made of a conductive nonwoven material, which is a material containing conductive fibers. By using a member made of such a material as the second charge eliminating portion 73, disturbance of an image is less likely to occur. That is, if the charge on the paper P is eliminated at the positions of the point projections 71*a* of the first charge eliminating portion 71, the distribution of static electricity eliminated from the paper P is likely to be uneven in the main scanning direction. More specifically, the distribution of static electricity is likely to be uneven in the portions where charge is eliminated by the point projections 71*a* and the portions where charge is eliminated between the pointed projections 71*a*. This is likely to cause disturbance of an image. In the second charge eliminating portion 73 according to the exemplary embodiment, the distribution of static electricity is likely to be even in the main scanning direction, so that disturbance of an image is less likely to occur.

The length in the shorter side direction of the second charge eliminating portion 73 is 5 mm, and the thickness thereof is 1 mm, for example. The distance of closest approach between the paper P and the second charge eliminating portion 73 when the paper P is transported is 1 to 2 mm, for example.

Description of Positional Relationship Between Charge Eliminating Unit and Transport Unit In the exemplary embodiment, the charge eliminating unit 70 and the transport unit 80 form a transport path YR (see FIG. 1). The transport unit 80 is disposed so that an angle formed by a transport direction with respect to a horizontal direction when the paper P passes the transport unit 80 is smaller than an angle formed by a transport direction with respect to the horizontal direction when the paper P passes the charge eliminating unit 70. Accordingly, the transport direction of the paper P is changed at the vicinity of the boundary between the charge eliminating unit 70 and the transport unit 80 on the transport path YR. In this way, the paper P is transported in a loop motion in a downward protruded shape.

Accordingly, wrinkles caused in the fixing unit 50 can be suppressed. That is, the paper P is transported in a loop motion along a curved line. In other words, the paper P is transported in a slack state. In this case, even if the end portions of the paper P do not enter the fixing nip area of the fixing unit 50 at almost the same time, that is, even if the paper P obliquely enters, wrinkles are less likely to occur. That is, if the paper P obliquely enters the fixing nip area, the stress that acts on the paper P is uneven in the main scanning direction of the paper P, which causes the paper P to become wrinkled. On the other hand, if the paper P is in a slack state, the slackness reduces the stress that acts on the paper P, so that wrinkles are less likely to occur.

Description of Functions of Charge Eliminating Unit

Next, a description will be given of the functions of the first charge eliminating portion 71 and the second charge eliminating portion 73.

In the exemplary embodiment, the second charge eliminating portion 73 largely eliminates static electricity on the paper P in order to suppress the above-described streaky pattern. The streaky pattern is a phenomenon that occurs when the potential on the lower side of the paper P, that is, the potential on the side of the second charge eliminating portion 73, is higher than a predetermined potential. Thus, the second charge eliminating portion 73 is disposed at the lower side of the paper P, thereby eliminating static electricity on the lower side of the paper P more effectively, so as to eliminate charge.

In the exemplary embodiment, the second charge eliminating portion 73 is disposed so as to be out of contact with the paper P. If the second charge eliminating portion 73 is disposed so as to be in contact with the paper P, a larger amount of static electricity is eliminated from the lower side of the paper P. As a result, a difference in the amount of static electricity becomes too large between the lower side and upper side of the paper P. This causes unbalanced potentials on the lower side and upper side of the paper P, so that the toner image formed on the upper side of the paper P easily moves. If the toner image moves, the image formed on the paper P is disturbed.

In the exemplary embodiment, the second charge eliminating portion 73 is disposed to be adjacent to the above-described position where the transport direction of the paper P is changed. At this position, a force is applied to the paper P, which is pressed from the lower side to the upper side, thereby changing the transport direction. Thus, the paper P is prevented from being transported while being floated above a predetermined transport path. Accordingly, the distance between the second charge eliminating portion 73 and the paper P is easily kept at a predetermined distance, and the amount of static electricity on the lower side of the paper P is easily kept within a predetermined range.

More specifically, the first charge eliminating portion 71 and the second charge eliminating portion 73 are disposed with a predetermined distance therebetween. If the distance between the first charge eliminating portion 71 and the second charge eliminating portion 73 is shorter than the predetermined distance, an electrical interaction occurs between the first charge eliminating portion 71 and the second charge eliminating portion 73, and another type of image disturbance is likely to occur. That is, in the exemplary embodiment, providing the second charge eliminating portion 73 suppresses image disturbance in which a streaky pattern appears in an image, but another type of image disturbance is likely to occur.

Figure 5A:
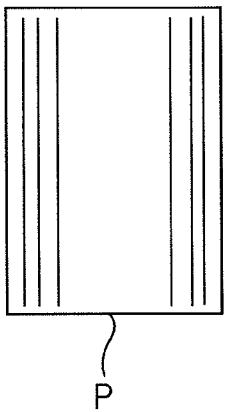
FIGS. 5A to 5C are conceptual diagrams describing various types of disturbance of an image.
Figure 5B:
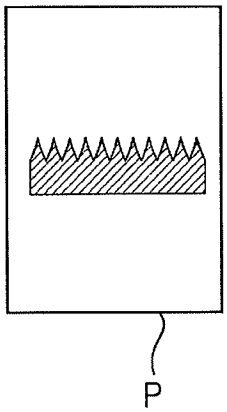
Figure 5C:
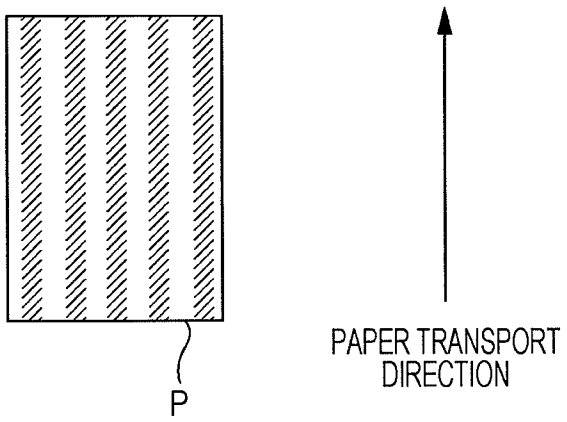

FIGS. 5A to 5C are conceptual diagrams describing various types of image disturbance.

FIG. 5A illustrates the image disturbance resulting from the ribs 82*a* provided in the transport unit 80. This type of image disturbance is a streak pattern that is caused at the positions where the paper P is brought into contact with the ribs 82*a* and that extends in the paper transport direction (sub-scanning direction). FIG. 5B illustrates the image disturbance resulting from providing the second charge eliminating portion 73. This type of image disturbance occurs on the entire surface of the paper P when toner is scattered in the transport direction of the paper P. In the example illustrated in FIG. 5B, a rectangular image is formed on the paper P, but toner is scattered and thus a sawteeth pattern is formed in the transport direction of the paper P. FIG. 5C illustrates the image disturbance resulting from providing the second charge eliminating portion 73. This type of image disturbance is a streak pattern formed in a halftone pattern in the transport direction of the paper P on the entire surface of the paper P.

The first charge eliminating portion 71 and the second charge eliminating portion 73 are disposed with a predetermined distance therebetween, so that the image disturbances illustrated in FIGS. 5B and 5C are suppressed. More specifically, the first charge eliminating portion 71 and the second charge eliminating portion 73 are disposed with a distance of 2 mm or more therebetween, for example.

Generally, the first charge eliminating portion 71 eliminates the static electricity on the paper P by applying a negative voltage of −3 kV or the like. In the exemplary embodiment, however, the first charge eliminating portion 71 is at a ground potential, so that the image disturbances illustrated in FIGS. 5B and 5C are suppressed more effectively.

Also, in the exemplary embodiment, the width in the paper transport direction of the second charge eliminating portion 73 is larger than the width in the paper transport direction of the first charge eliminating portion 71. Furthermore, the distance between the second charge eliminating portion 73 and the paper P is larger than the distance between the first charge eliminating portion 71 and the paper P. Accordingly, the second charge eliminating portion 73 eliminates a larger amount of static electricity, and the image disturbances illustrated in FIGS. 5A to 5C are less likely to occur.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charge eliminating device comprising:

a first charge eliminating portion that has pointed projections;

a transport guiding portion that is disposed on a downstream side of the first charge eliminating portion in a recording material transport direction; and a second charge eliminating portion that is attached to the transfer guiding portion and is disposed so as to be out of contact with a recording material, wherein a width in the recording material transport direction of the second charge eliminating portion is larger than a width in the recording material transport direction of the first charge eliminating portion, and the first charge eliminating portion and the second charge eliminating portion eliminate charge on the recording material.

2. The charge eliminating device according to claim 1, wherein the first charge eliminating portion is connected to a ground potential.

3. The charge eliminating device according to claim 1, wherein the transport guiding portion includes a plurality of protruding portions protruding beside the second charge eliminating portion, the plurality of protruding portions being formed so as to guide the recording material in the recording material transport direction.

4. An image forming apparatus comprising:

a toner image forming unit that forms a toner image;

a transfer unit that transfers the toner image formed by the toner image forming unit onto a recording material;

a fixing unit that fixes the toner image transferred by the transfer unit to the recording material;

a transport unit that includes a rotary member that transports the recording material from the transfer unit to the fixing unit and a recording material guiding portion that has first protruding portions extending along a recording material transport direction; and a charge eliminating unit that is disposed between the transfer unit and the transport unit and eliminates charge on the recording material, wherein the charge eliminating unit includes a first charge eliminating portion that has pointed projections, and a second charge eliminating portion that is disposed on a downstream side of the first charge eliminating portion in the recording material transport direction and is disposed so as to be out of contact with the recording material.

5. The image forming apparatus according to claim 4, wherein the first charge eliminating portion of the charge eliminating unit is connected to a ground potential.

6. The image forming apparatus according to claim 4, wherein a width in the recording material transport direction of the second charge eliminating portion is larger than a width in the recording material transport direction of the first charge eliminating portion in the charge eliminating unit.

7. The image forming apparatus according to claim 5, wherein a width in the recording material transport direction of the second charge eliminating portion is larger than a width in the recording material transport direction of the first charge eliminating portion in the charge eliminating unit.

8. The image forming apparatus according to claim 4,
wherein the transport unit is disposed so that an angle formed by the recording material transport direction with respect to a horizontal direction when the recording material passes the transport unit is smaller than an angle formed by the recording material transport direction with respect to the horizontal direction when the recording material passes the charge eliminating unit, thereby changing the recording material transport direction, and
wherein the second charge eliminating portion is disposed to be adjacent to a portion where the recording material transport direction is changed.

9. The image forming apparatus according to claim 5,
wherein the transport unit is disposed so that an angle formed by the recording material transport direction with respect to a horizontal direction when the recording material passes the transport unit is smaller than an angle formed by the recording material transport direction with respect to the horizontal direction when the recording material passes the charge eliminating unit, thereby changing the recording material transport direction, and
wherein the second charge eliminating portion is disposed to be adjacent to a portion where the recording material transport direction is changed.

10. The image forming apparatus according to claim 6,
wherein the transport unit is disposed so that an angle formed by the recording material transport direction with respect to a horizontal direction when the recording material passes the transport unit is smaller than an angle formed by the recording material transport direction with respect to the horizontal direction when the recording material passes the charge eliminating unit, thereby changing the recording material transport direction, and
wherein the second charge eliminating portion is disposed to be adjacent to a portion where the recording material transport direction is changed.

11. The image forming apparatus according to claim 7,
wherein the transport unit is disposed so that an angle formed by the recording material transport direction with respect to a horizontal direction when the recording material passes the transport unit is smaller than an angle formed by the recording material transport direction with respect to the horizontal direction when the recording material passes the charge eliminating unit, thereby changing the recording material transport direction, and
wherein the second charge eliminating portion is disposed to be adjacent to a portion where the recording material transport direction is changed.

12. The image forming apparatus according to claim 4, wherein the second charge eliminating portion of the charge eliminating unit is made of a material containing conductive fibers.

13. The image forming apparatus according to claim 5, wherein the second charge eliminating portion of the charge eliminating unit is made of a material containing conductive fibers.

14. The image forming apparatus according to claim 6, wherein the second charge eliminating portion of the charge eliminating unit is made of a material containing conductive fibers.

15. The image forming apparatus according to claim 7, wherein the second charge eliminating portion of the charge eliminating unit is made of a material containing conductive fibers.

16. The image forming apparatus according to claim 4, wherein the charge eliminating unit further includes a plurality of second protruding portions protruding beside the second charge eliminating portion.

17. The image forming apparatus according to claim 16, wherein the plurality of second protruding portions are formed so as to guide the recording material to the transport unit.

* * * * *